US005224570A

United States Patent [19]

Fromberg

[11] Patent Number: 5,224,570

[45] Date of Patent: Jul. 6, 1993

[54] BRAKE CATCHING DEVICE FOR ELEVATOR CAR AND COUNTERWEIGHT

[75] Inventor: Gunter Fromberg, Berlin, Fed. Rep. of Germany

[73] Assignee: Inventio AG, Hergiswil, Switzerland

[21] Appl. No.: 802,846

[22] Filed: Dec. 6, 1991

[30] Foreign Application Priority Data

Dec. 7, 1990 [CH] Switzerland ..... 03876/90

[51] Int. Cl.[5] ..... B66B 5/16

[52] U.S. Cl. ..... 187/88; 187/89

[58] Field of Search ..... 187/88, 90, 89; 188/189, 188

[56] References Cited

U.S. PATENT DOCUMENTS 2,897,920 8/1959 Falter et al. ..... 187/88
3,762,512 10/1973 McIntyre ..... 187/88

FOREIGN PATENT DOCUMENTS 925071 1/1953 Fed. Rep. of Germany .
2604157 8/1977 Fed. Rep. of Germany .
1189805 3/1970 United Kingdom .
2136773 9/1984 United Kingdom .

OTHER PUBLICATIONS

European Search Report and Annex.

*Primary Examiner*—D. Glenn Dayoan
*Assistant Examiner*—Kenneth Noland
*Attorney, Agent, or Firm*—Sandler Greenblum & Bernstein

[57] ABSTRACT

The brake catching device precludes the occurrence of excess speeds of an elevator car or counterweight in downward travel direction. At the front side of a housing there is provided a recess extending throughout the entire housing height, and at one end of such recess there is arranged a brake plate adjacent which there extends a free leg of a guide rail. A trapezoidal or tapered bracket member is inserted into the recess at the part thereof neighboring the free leg of the guide rail. This bracket member has a substantially rectangular-shaped extension protruding out of the housing. The bracket member is provided at the side confronting the guide rail with an upwardly inclined cam having a substantially U-shaped cross-section. Both front surfaces of the cam server as rolling tracks for roller shafts arranged at a cylindrical catching roller. At the lower portion of the cam there is provided a protrusion in the form of an additional control taper or incline for more rapidly urging the catching roller against the free leg of the guide rail. The recess is terminated at the side opposite the brake plate by a wedge taper against which bears the bracket member. A longitudinal slot extending in substantially vertical direction through the bracket member and deeply into the extension imparts a predetermined springiness or resilient characteristic to the bracket member.

15 Claims, 2 Drawing Sheets

BRAKE CATCHING DEVICE FOR ELEVATOR CAR AND COUNTERWEIGHT

BACKGROUND OF THE INVENTION

1. Field of the Invention

The present invention relates to elevator safety devices and, more specifically, relates to a new and improved brake catching device, also referred to in the art as a progressive safety or safety device, for an elevator car or counterweight.

Generally speaking, the elevator safety device of the present invention is of the type comprising a catching or catch roller arranged in a wedge or tapered area which interacts with a free leg member of a guide rail and a brake member, typically a brake plate or pad for braking to standstill an elevator car or a counterweight.

2. Discussion of the Background and Material Information

German Published Patent Application No. 2,604,157, published Aug. 11, 1977, discloses a brake catching device or progressive safety device comprising a guide wedge and a counter jaw member which, during normal operation of the elevator, are guided along a free leg member of a guide rail. The guide wedge is rotatably mounted at its lower end by a guide bolt and is retained at its upper end by an adjustable set of springs. In the event of a malfunction or emergency, a roller holder or mount is upwardly shifted. As a result, a catching roller is upwardly moved by means of a support out of a rest position along the edge of a guide wedge. Upon impact of the catching roller at the guide rail the guide wedge is deflected to one side, specifically to the right in such patent document, and the set of springs is loaded. Upward movement of the catching roll is limited by a braking wedge arranged at the upper end of the guide wedge. When the force exerted by the set of springs exceeds a predetermined value the entire device moves towards the right and the counter jaw bears against the guide rail.

A drawback of this prior art brake catching device or progressive safety is the considerable mechanical construction which is required for the rotatably mounted guide wedge and the set of springs acting upon the upper end of the guide wedge. A further shortcoming of this known brake catching device resides in the fact that prior to placing the same into operation and following the occurrence of a malfunction or emergency situation, there must be carried out an appreciable or critical adjustment of the set of springs and the braking wedge.

SUMMARY OF THE INVENTION

Therefore, with the foregoing in mind, it is a primary object of the present invention to provide an improved brake catching device for an elevator car or counterweight which is not afflicted with the aforementioned drawbacks and shortcomings of the prior art.

Another and more specific object of the present invention aims to provide an improved construction of a brake catching device or progressive safety device for an elevator car or counterweight which affords, with the use of fewer individual components or parts, the realization of a brake catch deceleration which can be accommodated to different total weights of elevator car and counterweight.

Still a further noteworthy object of the present invention is the provision of an improved brake catching device or progressive safety for an elevator car or counterweight which, by virtue of the relatively simple construction of the individual parts thereof, renders possible an extensively automated and quite economical fabrication of such brake catching device or progressive safety.

Yet a further significant object of the present invention is the provision of an improved brake catching device or progressive safety for an elevator car or counterweight which renders possible carrying out quite simple settings for adaptation of the brake catching device or progressive safety to different total weights of the elevator car and counterweight.

Now in order to implement these and still further objects of the present invention, which will become more readily apparent as the description proceeds, the brake catching device or progressive safety device for an elevator car or counterweight of the present development is manifested, among other things, by the features that a bracket member which is displaceable along a wedge taper or ramp-like incline surface of a housing is provided with a cam arranged at the side of the guide rail and which guides the catching or catch roller.

Stated in another way, the brake catching device for an elevator car or counterweight of the present invention is of the type comprising a housing provided with a wedge area, and a guide rail provided with a free leg member extends into the wedge area. A brake or braking plate is arranged in the wedge area in cooperative relation with the free leg member of the guide rail. Furthermore, a catching roller is arranged in the wedge area and interacts with the free leg member of the guide rail and the brake plate for braking to standstill the elevator car or counterweight. The housing comprises a wedge taper and a bracket member is displaceable along the wedge taper of the housing. Cam means are provided for the bracket member at the side of the guide rail for guiding the catching roller.

According to a further feature, the cam means extend upwardly at an inclination within the housing, such cam means possess a substantially U-shaped cross-section and comprise two front surfaces serving as roller tracks for the catching roller.

Still further, these two front surfaces of the cam means define rolling paths for the catching roller. The upper portion and the lower portion of the cam means merge into an associated arcuate-shaped end region which limits the rolling paths for the catching roller.

According to a further aspect of the present invention, the cam means has a lower portion equipped with a raised portion or protrusion defining a control incline or ramp for rapidly guiding or camming the catching roller towards the free leg member of the guide rail.

As to a further development, the bracket member comprises a substantially rectangular extension protruding out of the housing, and means cooperate with this substantially rectangular extension for displacing the bracket member along the wedge taper.

It is additionally contemplated to have a substantially upright longitudinal slot extend through the bracket member and deeply into, that is to say, throughout a major portion of the extension for imparting a predetermined spring characteristic or springiness to the bracket member.

According to a further feature of the present invention there is provided a cover plate at the housing for displaceably retaining the bracket member.

With regard to still another aspect, the catching roller comprises a substantially cylindrical knurled outer surface, cylindrical end surfaces and roller shafts arranged at the cylindrical end surfaces of the catching roller, and these roller shafts roll upon the aforementioned roller tracks.

Additionally, there can be provided actuation arm means for placing the catching roller into movement upon the occurrence of a malfunction of the elevator car or counterweight.

One of the notable advantages realized with the inventive construction of brake catching device or progressive safety essentially resides in the extensively automated fabrication of such brake catching device or progressive safety by virtue of the relatively simple construction of the individual parts or components thereof. A further benefit of the present invention resides in the simple setting work needed for adapting or accommodating the brake catching device or progressive safety to different total weights of elevator car and counterweight. The just considered attainment of automated fabrication as well as simple setting work have a positive effect upon the manufacturing costs of the inventive brake catching device or progressive safety which are fabricated in large numbers or series.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
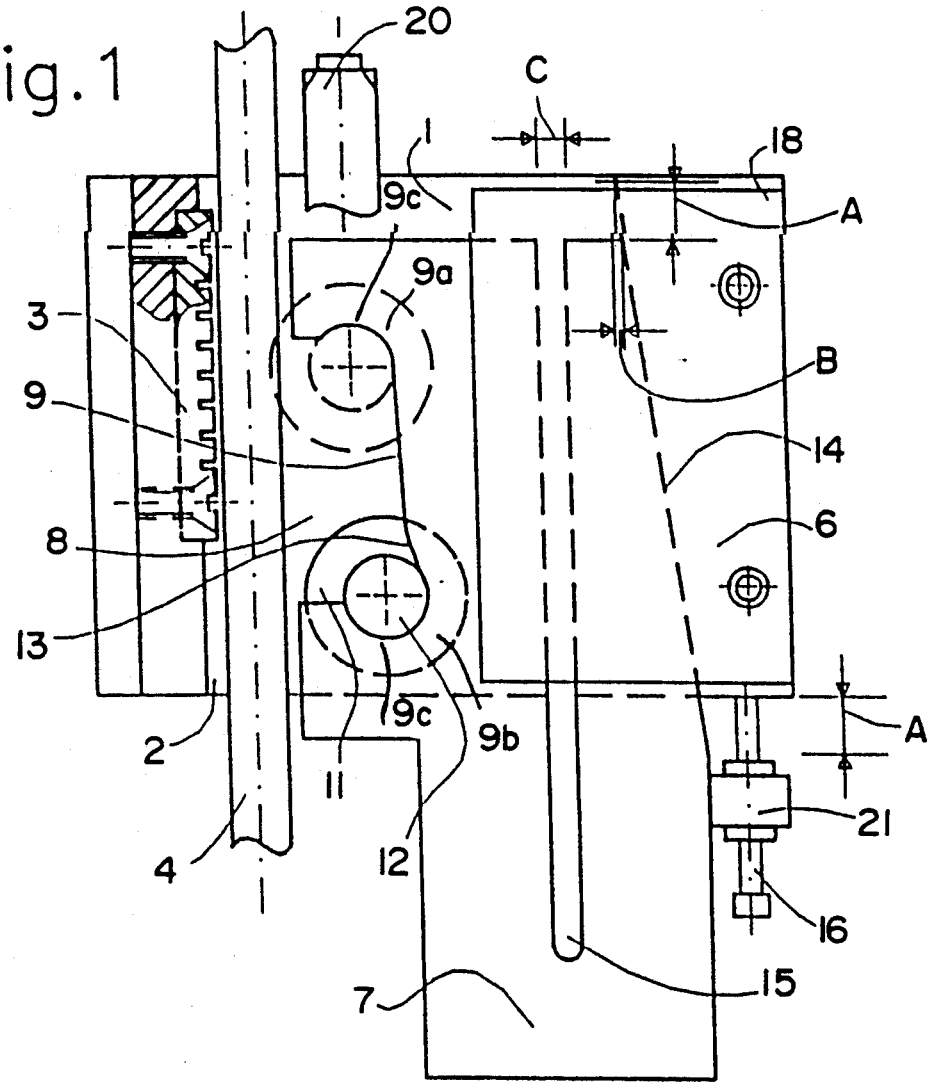
FIG. 1 is a schematic front view of a brake catching device according to the present invention containing a catching roller arranged in a wedge or tapered area or gap and a brake plate or pad for braking an elevator cabin or a counterweight.

Describing now the drawings, it is to be understood that only enough of the construction of one exemplary embodiment of brake catching device or progressive safety device constructed according to the teachings of the present invention has been depicted therein, in order to simplify the illustration, as needed for those skilled in the art to readily understand the underlying principles and concepts of the present invention.

Turning attention now to FIGS. 1 to 4, reference numeral 1 designates a housing provided with a recess or channel 2 which extends at the front side 1*a* of such housing 1 throughout the entire height thereof. At one end or end region of the recess or channel 2 there is arranged a brake member, here a brake or braking plate or pad 3. A free leg or leg member 4 of a guide rail 5 extends into the recess or channel 2 adjacent the brake plate or pad 3. A tapered or wedge bracket member 6, here a substantially trapezoidal-shaped bracket member having a substantially rectangular extension or projection 7 protruding out of the housing 1, is inserted into the part of the recess or channel 2 neighboring the leg 4 of the guide rail 5.

The bracket member 6 is provided at its side or region confronting the guide rail 5 with a cam or cam means 9 extending upwardly at an inclination or taper and which forms a wedge or taper gap or area 8. As will be observed from the showing of FIGS. 1 to 3, this cam or cam means 9 has a substantially U-shaped cross-section which merges at its bottom and top regions 9*a* and 9*b*, respectively, into an associated substantially circular-shaped or arcuate portion or region 9*c*. Both of the front or end surfaces 10*a* of the cam or cam means 9 serve as roller tracks or pathways 10 for roller shafts or axles 12 of a substantially cylindrical catching or catch roller 11 having a knurled outer surface 11*a*. At the lower portion of the cam or cam means 9 there is provided a raised portion or protrusion in the form of an additional control incline or camming surface 13 by means of which the catching roller 13 can be more rapidly guided or cammed against the free leg 4 of the guide rail 5.

As best seen from FIG. 1, the recess or channel 2 is terminated at the side thereof located opposite the brake plate 3 by a wedge taper or ramp-like incline surface 14 against which bears cooperating abutting surface of the bracket member 6. The required springiness or resilient action is imparted to the bracket member 6 by means of a longitudinal or lengthwise slot 15 which extends in substantially vertical or upright direction in FIG. 1 through such bracket member 6 and throughout a considerable or major portion of the extension or projection 7.

Figure 2:
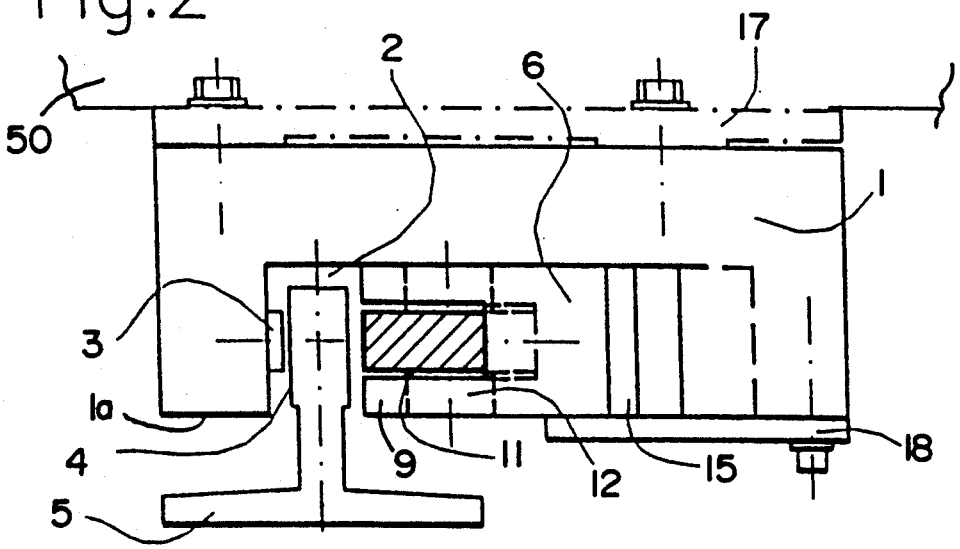
FIG. 2 is a schematic top plan view of the brake catching device depicted in FIG. 1.
Figure 3:
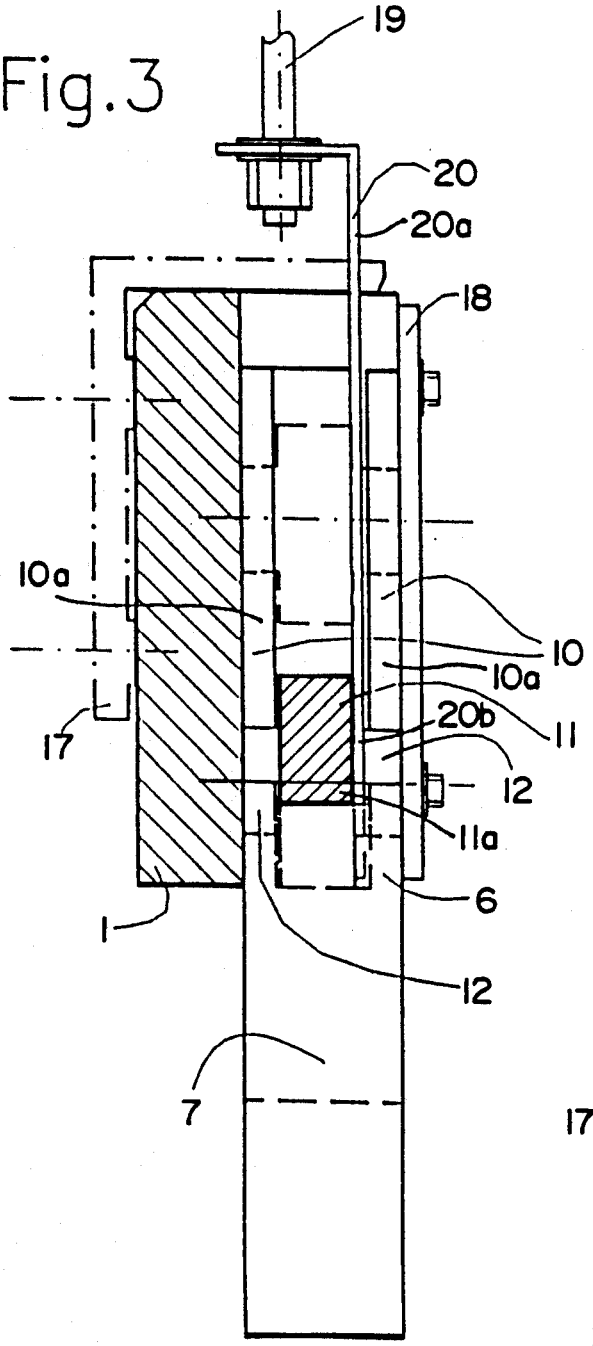
FIG. 3 is a schematic front view of the brake catching device depicted in FIG. 1 as viewed in the direction of the catching roller.
Figure 4:
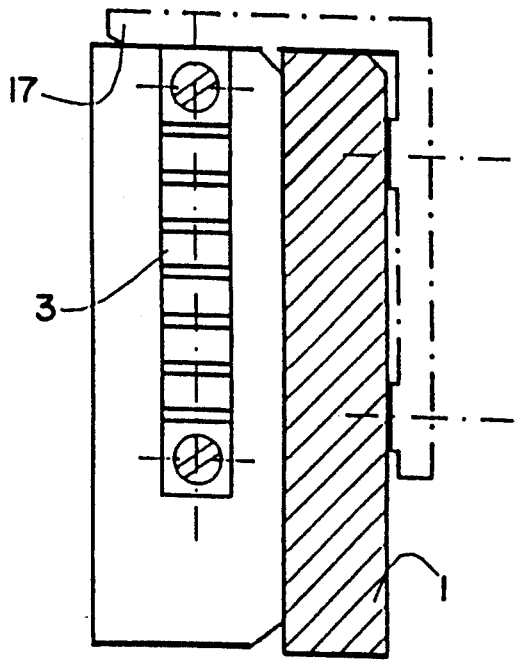
FIG. 4 is a schematic front view of the brake catching device depicted in FIG. 1 as viewed in the direction of the brake plate or pad.

With further reference to FIGS. 1 and 2, it will be seen that one end of a threaded adjustment element, here a threaded screw or bolt 16 is connected with a support or carrier member 17 arranged at the housing 1, and the other end or end region of such threaded screw or bolt 16 is connected with a flap or tongue 21 or equivalent structure arranged at the extension or projection 7. An elevational displacement or shift, as indicated in FIG. 1 by reference character A, of the extension or projection 7 by appropriately turning the threaded screw or bolt 16, results in a transverse or lateral displacement B of the bracket member 6. As a result, the bracket member 6, which is displaceably retained by a cover plate 18, slides along the wedge taper or incline surface 14 and alters the spacing of the catching roller 11 from the free leg 4 of the guide rail 5. This spacing or distance between the catching roller 11 and the free leg 4 of the guide rail 5, in turn, determines the brake catching deceleration which is to be accommodated to the different total weights of the elevator car and counterweight, merely generally schematically indicated in FIG. 1 by reference character 50, as well as also the spring or resilient characteristic of the bracket member 6 as indicated by reference character C.

In the event of a malfunction of the elevator or there arising an emergency situation, i.e., during an abnormal operating condition of the elevator or counterweight, a not particularly illustrated but conventional speed limiter or governor actuates by means of a traction element a linkage or lever mechanism 19 which is operatively connected with one end 20*a* of an actuation arm 20 extending into the recess or channel 2 of the housing 1. The catching roller 11 rotatably arranged at the other end 20*b* of the actuation arm, is deflected or shifted out of its rest position and pulled upwardly within the wedge or tapered gap or area 8, resulting in the roller shafts or axles 12 of the catching roller 11 rolling through the predetermined path defined by the roller tracks 10. By virtue of the upwardly directed relative movement of the catching roller 11 along the roller tracks 10, the brake or braking plate 3 is brought into operative braking engagement with the free leg 4 of the guide rail 5. By means of the spring or resilient bracket 6 the catching roller 11 is pressed, without internal frictional loss, progressively with increasing force against the free leg 4 of the guide rail 5 and the elevator cabin or counterweight, as the case may be, braked to standstill.

By way of completeness it is here remarked that the use of a speed governor in conjunction with a linkage mechanism for operating a safety actuator gear is known, for instance, from British Patent Application No. 2,136,773, published Sep. 26, 1984, to which reference may be readily had, and such arrangement can be analogously employed in the system of the present invention.

While there are shown and described present preferred embodiments of the invention, it is distinctly to be understood the invention is not limited thereto, but may be otherwise variously embodied and practiced within the scope of the following claims.

What is claimed is:

1. A brake catching device for an elevator car or counterweight comprising:

a housing provided with a wedge area:

a guide rail provided with a free leg member extending into the wedge area;

a brake plate arranged in the wedge area in cooperative relation with the free leg member of the guide rail;

a catching roller arranged in the wedge area;

the catching roller interacting with the free leg member of a guide rail and the brake plate for braking to standstill the elevator or counterweight;

said housing comprising a wedge taper;

a bracket member having cam means at the side of the guide rail for guiding the catching roller; and means for displacing the bracket member with respect to the housing along the wedge taper.

2. The brake catching device according to claim 1, wherein:

said cam means extends upwardly at an inclination within the housing; and said cam means possessing a substantially U-shaped cross-section and comprising two front surfaces serving as roller tracks for the catching roller.

3. The brake catching device according to claim 2, wherein:

the two front surfaces define rolling paths for the catching roller;

said cam means has an upper portion and a lower portion; and each said upper portion and lower portion of the cam means merging into an associated substantially arcuate-shaped end region which limits the rolling paths for the catching roller.

4. The brake catching device according to claim 1, wherein:

said cam means has a lower portion equipped with a protrusion defining a control incline for rapidly guiding the catching roller towards the free leg member of the guide rail.

5. The brake catching device according to claim 1, wherein:

the bracket member comprises a substantially rectangular extension protruding out of the housing; and said for displacing the bracket member along the wedge taper comprises means cooperating with the substantially rectangular extension for displacing the bracket member along the wedge taper.

6. The brake catching device according to claim 1, wherein:

the bracket member comprises an extension protruding out of the housing; and a substantially upright longitudinal slot extending through said bracket member and into a major portion of the extension for imparting a predetermined spring characteristic to the bracket member.

7. The brake catching device according to claim 1, further including:

a cover plate provided at the housing for displaceably retaining the bracket member.

8. The brake catching device according to claim 1, wherein:

said cam means possessing a substantially U-shaped cross-section and comprising two front surfaces serving as roller tracks for the catching roller;

the catching roller comprising a substantially cylindrical knurled outer surface, cylindrical end surfaces and roller shafts arranged at the cylindrical end surfaces of the catching roller; and said roller shafts rolling upon said roller tracks.

9. The brake catching device according to claim 1, further including:

actuation arm means for placing the catching roller into movement upon the occurrence of a malfunction of the elevator car or counterweight.

10. The brake catching device according to claim 1, wherein:

the brake plate is fixedly mounted to the housing.

11. A brake catching device for an elevator car or counterweight which travel along a guide rail, said device comprising:

a housing;

a brake pad attached to said housing in cooperative relation with the guide rail;

a bracket member having a cam surface;

a catching member positioned for movement along said cam surface to effect engagement with said guide rail for braking said elevator or counterweight during an abnormal operating condition, said catching member having a predetermined spacing from said guide rail during a normal operating condition; and means for selectively adjustably displacing said bracket member and said cam surface with respect to said housing to alter said predetermined spacing of said catching member from said guide rail during the normal operating condition.

12. The brake catching device according to claim 11, wherein:

said housing comprises an inclined surface and said bracket comprises an abutting surface, said abutting surface of said bracket abutting agent said inclined surface of said housing;

said means for selectively adjustably displacing said bracket member and said cam surface comprises means for selectively adjustably displacing said abutting surface along said inclined surface.

13. The brake catching device according to claim 11, wherein:

said catching member comprises a catching roller, said catching roller having portions for engagement with said cam surface.

14. The brake catching device according to claim 11, wherein:

said bracket member comprises means for imparting a predetermined spring characteristic to said bracket member.

15. The brake catching device according to claim 14, wherein:

said means for imparting a predetermined spring characteristic to said bracket member comprises a generally longitudinally extending slot to facilitate a predetermined resilient movement of said cam means toward and away from the guide rail.

* * * * *